US005951274A

United States Patent [19]

Bellemann et al.

[11] Patent Number: 5,951,274

[45] Date of Patent: Sep. 14, 1999

[54] INTERNAL-GEAR MACHINE

[75] Inventors: Stefan Bellemann, Malsch-Völkersbach; Otto Eckerle, Malsch, both of Germany

[73] Assignee: Eckerle Industrie-Elektronik GmbH, Malsch, Germany

[21] Appl. No.: 09/026,081

[22] Filed: Feb. 19, 1998

[30] Foreign Application Priority Data

Feb. 20, 1997 [DE] Germany ..... 197 06 639

[51] Int. Cl.[6] ..... F01C 1/10

[52] U.S. Cl. ..... 418/126; 418/170; 74/413

[58] Field of Search ..... 418/126, 170; 74/413

[56] References Cited

U.S. PATENT DOCUMENTS

| | | | |
|---|---|---|---|
| 3,486,459 | 12/1969 | Eltze | 418/126 |
| 4,472,123 | 9/1984 | Eckerle et al. | 418/126 |
| 5,690,481 | 11/1997 | Eckerle | 418/126 |

FOREIGN PATENT DOCUMENTS

| | | |
|---|---|---|
| 29 54 546 C2 | 7/1989 | Germany . |
| 43 36 966 A1 | 5/1995 | Germany . |

*Primary Examiner*—Allan D. Herrmann
*Attorney, Agent, or Firm*—Hoffmann & Baron, LLP

[57] ABSTRACT

An internal-gear machine comprises a casing with an internally toothed annular gear rotatable therein, an externally toothed pinion engaged with the annular gear and a filling member between the annular gear and the pinion. The filling member is subdivided into two portions by a substantially circumferentially extending separating surface. The filling member portions have respectively mutually oppositely disposed recesses which extend from the separating surface and which each have an inclined surface parallel to the axis of the machine. The inclined surfaces are in a wedge-shaped relationship with each other and a sealing roller is arranged in the wedge-shaped space. The sealing roller is pressed against the inclined surfaces by a hairpin spring operatively disposed between the sealing surface and a support surface. The spring limbs bear against the sealing roller and the support surface while the bent end of the spring projects into a free space in the casing.

11 Claims, 4 Drawing Sheets

INTERNAL-GEAR MACHINE

FIELD OF THE INVENTION

The invention concerns an internal-gear machine such as an internal-gear pump.

BACKGROUND OF THE INVENTION

A typical form of an internal-gear machine such as a pump comprises a casing with an internally toothed annular gear rotatably disposed therein, and an externally toothed pinion which is in meshing engagement with the annular gear. A filling member is disposed in the space between the annular gear and the pinion and is subdivided into two portions by a separating surface extending substantially in a peripheral direction. In a construction of that kind, as is to be found in DE-C-29 54 546, the separating surface which subdivides the filling member into the two portions has recesses which extend therefrom and which are disposed in respective mutually opposite relationship. The recesses have inclined surfaces which are in a wedge-like configuration relative to each other and which face in the same direction, namely from the pressure side of the machine to the suction side thereof. The machine further has a respective sealing roller which bears against each of the above-mentioned inclined surfaces and is loaded by a leaf spring in order thereby in operation of the machine to spread the portions of the filling member under the pressure acting on the sealing roller and thus to apply the portions of the filling member against the tips of the teeth on the pinion and the annular gear respectively. The leaf spring is operatively disposed between the sealing roller and a support surface which is disposed in the space at the separating surface, which is formed by the recesses in the filling member portions.

The leaf spring disposed in the above-mentioned separating surface space of the filling member is necessarily very small and therefore has to be produced and installed with a high degree of precision in order to apply a fairly precisely predetermined spring force to the sealing roller. This is a complicated and therefore expensive matter while nonetheless it is not possible reliably to avoid a fluctuation in the spring force applied to the sealing roller by the leaf spring, depending on where the tolerance dimensions of the leaf spring and the separating surface space defined by the recesses therein happen to occur.

For that reason in another structure, as is to be found in DE-A-43 36 966, a spring element for loading the sealing roller is fixed with a fixing portion thereof to one of the axial plates or housing walls of the machine, which bear axially against the filling member. Extending from the fixing portion of the spring element is a spring portion which is oriented in approximately parallel relationship with the axis of the machine and which bears against the sealing roller and which is suitably prestressed in that condition. That structural configuration admittedly permits production of the spring for loading the sealing roller to be easier and therefore less expensive. It will be noted however that the production and assembly expenditure of the internal-gear machine is not substantially reduced as a result because, in order to achieve a substantially reproducibly identical spring loading at the sealing roller, the bore provided for receiving the fixing portion of the spring in the housing of the machine or in the axial plate thereof must be very precisely positioned. Removal and fitting of the spring when implementing repair operations is also found to be a difficult operation.

SUMMARY OF THE INVENTION

An object of the present invention is to provide an internal-gear machine such as a pump which is of a simpler and therefore less expensive configuration in regard to the nature and arrangement of a spring for acting on a sealing roller associated with a filling member between the annular gear and the pinion.

Another object of the present invention is to provide an internal-gear machine having a filling member with a spring-loaded sealing roller associated therewith, which permits simple fine tuning of the spring loading on the sealing roller.

Still a further object of the present invention is to provide an internal-gear machine such as a pump having a spring-loaded filling member arrangement between the annular gear and the pinion, such as to improve the operating performance of the machine.

In accordance with the principles of the present invention the foregoing and other objects are attained by an internal gear machine such as a pump comprising a casing, an internally toothed annular gear rotatably disposed in the casing, an externally toothed pinion in engagement with the annular gear, and a filling member operatively disposed in the space between the annular gear and the pinion and subdivided into first and second filling member portions by a separating surface extending substantially in a peripheral direction. The filling member portions have recesses which start from the separating surface therebetween and which are disposed in mutually opposite relationship. Each recess has an inclined surface which is parallel to the axis of the machine, and the inclined surfaces define a wedge-like configuration relative to each other. A sealing roller is arranged movably in the space formed at the separating surface by the recesses and is pressed against the inclined surfaces by the liquid pressure and by means of a spring which is operatively disposed between the sealing roller and a support surface of the space at the separating surface. The sealing roller is thereby operative to spread the filling member portions from each other. The spring is curved in a hairpin shape and bears with its limbs in approximately parallel relationship with the axis of the machine against the sealing roller and the support surface respectively, and projects with its curved or bent end into a free space in the casing or an axial plate which bears against the filling member.

As will be seen in greater detail from embodiments of the present invention described hereinafter with reference to the drawing the adoption in accordance with the invention of a hairpin-shaped spring which bears with its two limbs against the sealing roller on the one hand and against the support surface in the space defined by the separating surface between the two portions of the filling member on the other hand, and which projects with its curved end into a space in a wall of the casing or an axial plate at the end of the casing makes it possible to avoid the size limitation which is imposed by virtue of the space defined at the separating surface between the filling member portions, while also making it possible to implement comparatively considerably larger spring dimensions. Thus the spring can be of a length which projects considerably beyond the filling member and into the above-mentioned free space, whereby it is possible more easily to produce a reproducibly uniform or regular spring characteristic. It will be appreciated that the structure of the internal-gear machine according to the invention requires a bore to form the above-mentioned free space in the casing or in an axial plate thereon, but precise positioning of the free space is no longer an important consideration because it only has to provide a place to receive the end of the spring. The free space for accommodating the end of the spring is therefore only roughly adapted to the dimensions of the spring, and the position of the spring is defined exclusively by the co-operation thereof with the sealing roller and the support surface in the filling member itself.

In accordance with a preferred embodiment of the present invention the filling member portions are shaped symmetrically with respect to a radial plane which contains the axis of the pinion, and spring-loaded sealing rollers are accommodated in correspondingly symmetrically arranged spaces at the separating surface between the filling member portions. Corresponding thereto there are also symmetrically arranged free spaces for accommodating the spring ends.

In a further preferred feature of the invention the filling member portions are each separately supported at a filling member pin which is flattened at mutually opposite sides to form radially directed sliding surfaces and engages into an axial groove at the longitudinal center of the filling member portions. The lateral flats on the filling member pin ensure limited radial displaceability of the filling member portions, which serves to provide an adjustment or take-up effect in the course of wear at the tips of the teeth and/or the filling member.

In order to provide for pivotability, which serves for the same purpose, of the filling member portions about the respectively associated filling member mounting pin, the pin can be rotatably mounted in the casing of the machine. For that purpose, in accordance with a further preferred feature of the invention, the filling member pin is either of a cylindrical shape, corresponding to its mounting bore, or, in a less expensive design configuration, it is of a substantially square cross-section which is bevelled at the edges. The bevels provide for rotatable mounting in the associated bore in the casing.

Further objects, features and advantages of the invention will be apparent from the following description of preferred embodiments of a machine according to the invention such as a pump.

DESCRIPTION OF THE PREFERRED EMBODIMENTS

Figure 1:
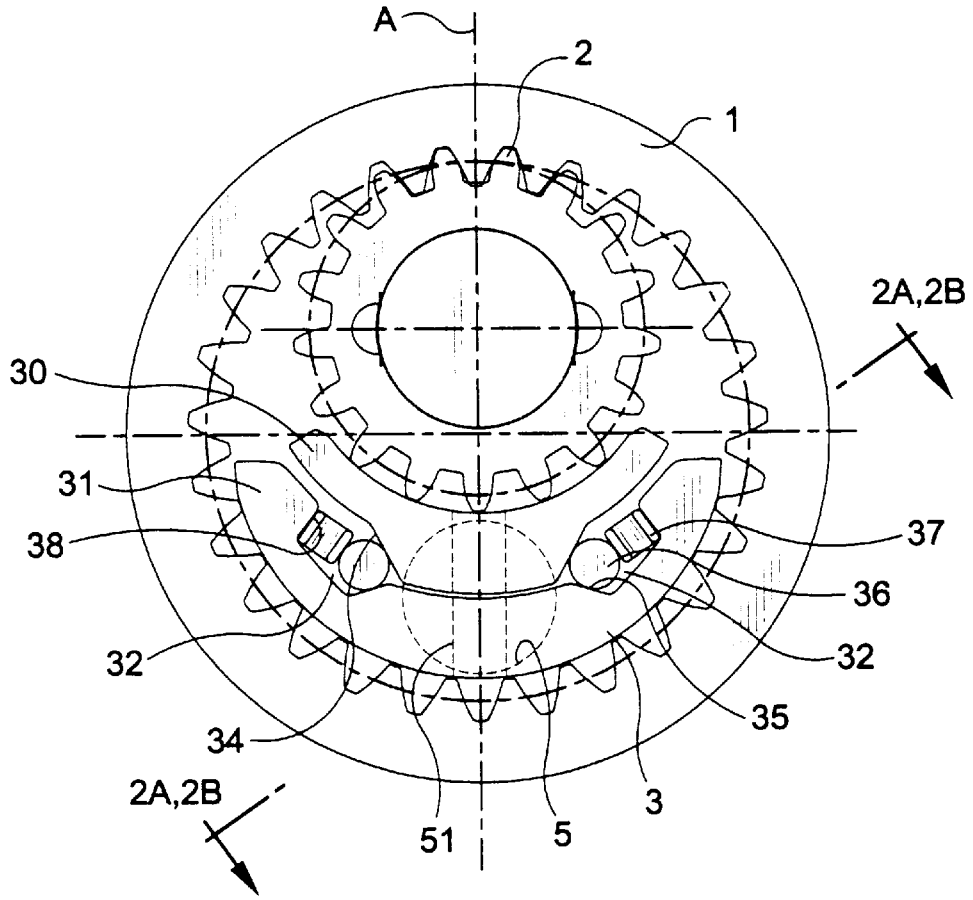
FIG. 1 is an end view of the operating assembly of an internal-gear machine according to the invention in the form of a pump, with the casing being omitted for the sake of enhanced clarity of the drawing.

Referring firstly to FIG. 1, an internal-gear machine according to the invention, for example a pump, has an operating assembly which substantially comprises an internally toothed annular gear 1, an externally toothed pinion 2 which meshes with the annular gear 1, and a filling member which is generally identified by reference numeral 3 and which is operatively disposed in a space between the annular gear 1 and the pinion 2. The annular gear 1 is mounted rotatably in conventional manner (which will therefore not be described in greater detail herein) in a casing of which part is generally indicated at 4 in FIG. 2 and which comprises axial casing portions that bear sealingly against the axially facing surfaces of the annular gear 1, the pinion 2 and the filling member 3. As the general structure of the internal-gear machine in this respect is sufficiently well-known it will not be described in greater detail herein, but reference may be directed to DE-A-43 36 966 for further information in this respect, the content thereof hereby being incorporated into this specification.

The filling member 3 is divided by a separating surface which extends approximately in the peripheral direction of the assembly in FIG. 1, into first and second filling member portions indicated at 30 and 31, comprising a radially inward filling member portion 30 which bears against the tips of the teeth on the pinion 2 and a radially outward filling member portion 31 which bears against the tips of the teeth of the annular gear 1. The filling member 3 and thus the portions 30, 31 thereof are of a symmetrical configuration relative to a radial plane indicated at A, in which the axis of the pinion 2 is disposed, and they form symmetrically arranged separating surface spaces indicated at 32 of the same configuration. It will be seen from FIG. 1 that each filling member portion 30, 31 has a respective recess at each side of the radial plane A, the recesses starting from the separating surface, and the recesses at each side of the radial plane A being disposed in mutually opposite relationship to define the respective separating surface space 32 at the respective side of the radial plane A. It will further be noted that, in the region of each separating surface space 32, the filling member portions 30, 31 have in the respective recesses referred to above, an inclined surface 34, 35 which is parallel to the axis of the machine and which are in a wedge-like configuration relative to each other and face towards the radial plane A of symmetry.

A respective sealing roller 36 is arranged movably in each of the separating surface spaces 32 formed by the above-mentioned recesses at the separating surface between the filling member portions and bears against the inclined surfaces 34, 35 in each separating surface space 32. The sealing roller 36 is pressed against the inclined surfaces 34, 35 by the liquid pressure in the machine and also by the force of a spring 37 of a hairpin-like shape.

Figure 2A:
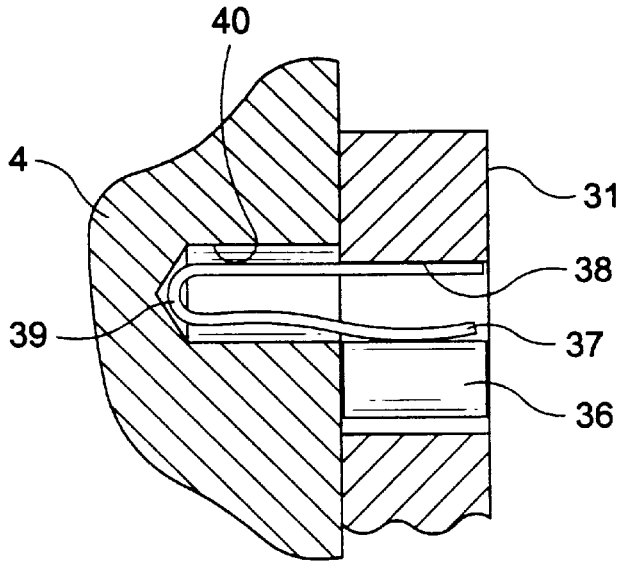
FIG. 2A is a view in section taken along line II—II in FIG. 1 showing part of the arrangement.

Referring now also to FIG. 2A, the hairpin spring 37 comprises a suitably bent or curved strip of flat material. The limbs of the spring 37 are directed in approximately parallel relationship with the axis of the pinion 2 and of the annular gear 1 and bear on the one hand against the sealing roller 36 and on the other hand against a shoulder 38 on the radially outward filling member portion 31. The shoulder 38 thus forms a support surface for the spring 37 in the separating surface space 32. The end 39 of the spring 37, which is curved or bent in a hairpin-like shape, is accommodated in a free space 40 in the casing 4, as can be clearly seen from FIG. 2A. In the illustrated embodiment of FIGS. 1 and 2A, the free space 40 is a bore whose cross-section is sufficiently large that on the one hand it can freely accommodate the curved end of the spring 37, while on the other hand it also permits slight movements of the filling member 3 without contact in respect of the spring 37 with the wall of the bore forming the free space 40.

Figure 2B:
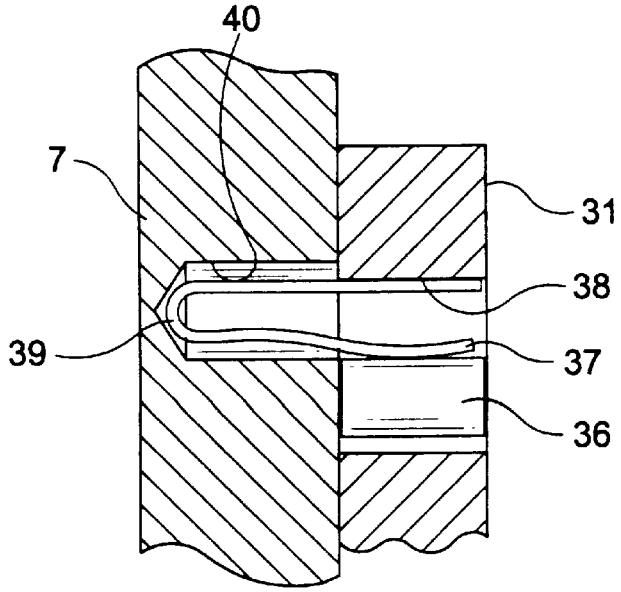
FIG. 2B is a sectional view of an alternative embodiment of the arrangement shown in FIG. 2A.

Referring now to FIG. 2B, as an alternative to the configuration just described above the free space 40 may be provided in an axial plate 7 forming an end portion of the casing and bearing against the adjacent surface of the filling member 3.

The filling member portions 30 and 31 are mounted pivotably and radially displaceably by a filling member mounting pin indicated at 5 in FIG. 1. The pin 5 is rotatably accommodated with a cylindrical end thereof in an associated mounting bore in the casing 4 while at its end surface which is towards the filling member 3 the pin 5 has a rib 51 which is flat on both sides and which engages into a corresponding groove at the axial flanks of the filling member portions 30 and 31. Reference may be directed in relation to that construction to above-mentioned DE-A-43 36 966 for further details of this structure. The mode of mounting the pin 5 in the casing 4 provides for pivotability of the filling member portions 30 and 31 while the fact that the flat rib 51 on the pin 5 is accommodated in the corresponding groove in the filling member portions 30 and 31 affords the limited radial displaceability of the latter.

Figure 3:
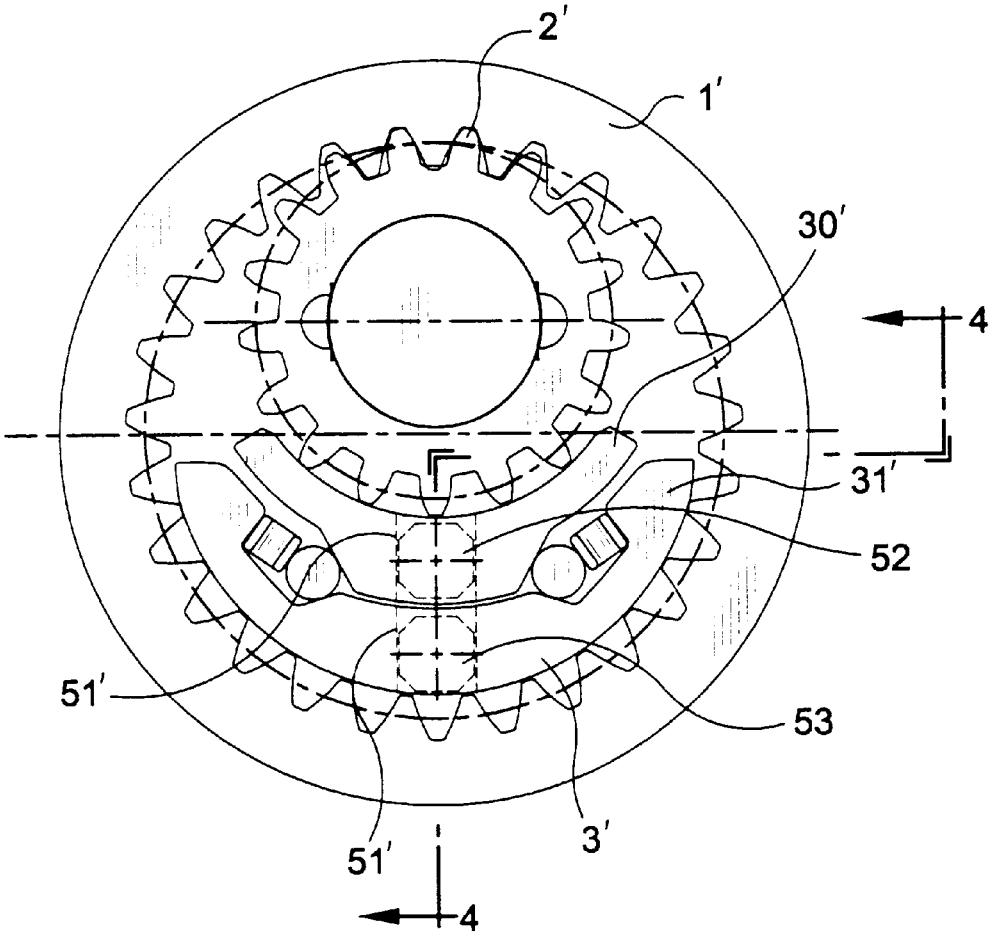
FIG. 3 is a view similar to that shown in FIG. 1 of the operating assembly of a modified embodiment of the invention.
Figure 4:
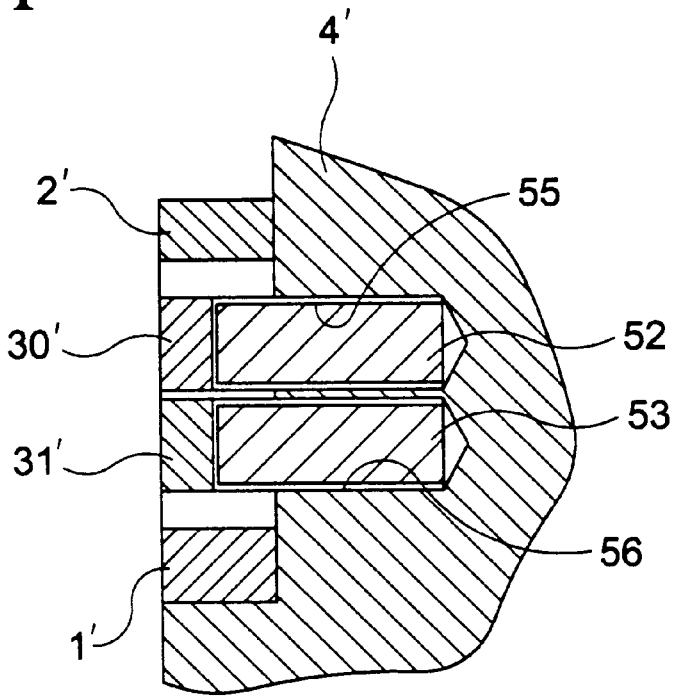
FIG. 4 is a view in section taken along line IV—IV in FIG. 3 showing part of the arrangement.
Figure 5:
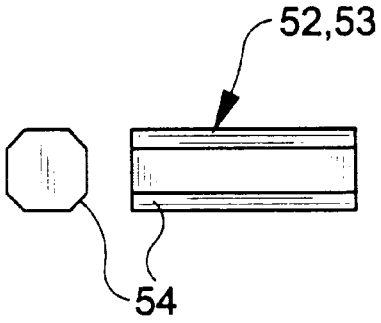
FIG. 5 shows end and side views of a filling member pin which is used in the embodiment of FIGS. 3 and 4.

Reference will now be made to the embodiment shown in FIGS. 3 through 5. This further embodiment of the invention only differs from the embodiment described hereinbefore with reference to FIGS. 1 and 2A insofar as the filling member portions which in this embodiment are identified by references 30' and 31' are not mounted on a common filling member pin but are each mounted separately on their own filling member pin as indicated at 52 and 53 in FIGS. 3 through 5. The two pins 52, 53 are each of a substantially square cross-section, the corners of which are rounded off to constitute bevel-like configurations as indicated at 54, so that, more precisely, the pin 52, 53 is of a generally octagonal cross-section, as can be clearly seen from FIG. 5. The two filling member mounting pins 52, 53 are rotatably accommodated in bores 55, 56 in the casing 4', as shown in FIG. 4. With their ends which are towards the filling member 3', the pins 52, 53 project into corresponding grooves 51' in the two filling member portions and hold them radially displaceably, in a similar manner to that described with reference to the embodiment of FIGS. 1 and 2A.

It will be noted at this point that the spring may be of such a length that at least one of the spring ends which is opposite to the curved or bent spring end 39 also projects into an associated free space in the casing or an axial plate fixed thereto.

It will be appreciated that the above-described embodiments of the invention have been set forth solely by way of example and illustration thereof and that various other modifications and alterations may be made therein without thereby departing from the spirit and scope of the invention.

What is claimed is:

1. An internal-gear machine comprising a casing, an internally toothed annular gear rotatably mounted in the casing, an externally toothed pinion in engagement with the annular gear in part thereof, with a space between the pinion and the annular gear in another part thereof, a filling member in the space between the annular gear and the pinion and having a substantially peripherally extending separating surface subdividing it into first and second filling member portions, the filling member portions having recesses which extend from the separating surface and are in respective mutually opposite relationship and each have an inclined surface parallel to the axis of the machine, the inclined surfaces being in a wedge-like configuration relative to each other to define a space at said separating surface, a sealing roller arranged movably in the separating surface space and adapted to be pressed against said inclined surfaces by liquid pressure, a support surface at said separating surface space, a spring operatively disposed between the sealing roller and the support surface, to spread the filling member portions away from each other, the spring being curved in a hairpin shape and having limbs bearing in at least substantially parallel relationship against the sealing roller and the support surface respectively, and having a curved end, and a free space in a portion of the casing, the curved end of the spring being accommodated in said free space.

2. A machine as set forth in claim 1 wherein said portion of the casing is a main body portion thereof.

3. A machine as set forth in claim 1 wherein said portion of the casing is an axial plate which bears against the filling member.

4. An internal-gear machine as set forth in claim 1 wherein said portion of the casing has a further free space adapted to accommodate at least one of said spring ends which is opposite to said curved end of the spring.

5. An internal-gear machine as set forth in claim 1 wherein said filling member is of a symmetrical shape with respect to a radial plane containing the axis of the pinion, and has symmetrically arranged separating surface spaces containing respective sealing rollers engaged by respective springs, a respective free space in a portion of the casing being associated with each said spring.

6. An internal-gear machine as set forth in claim 1 including a filling member mounting pin means for mounting said filling member portions rotatably and radially displaceably.

7. An internal-gear machine as set forth in claim 1 including a respective filling member portion mounting pin means for separately supporting each said filling member portion, each said pin means being flattened at mutually opposite sides to provide radially directed slide surfaces, adapted to engage into an axial groove in each said filling member portion.

8. An internal-gear machine as set forth in claim 7 wherein each said pin means is of substantially square cross-section with bevelled edges.

9. An internal-gear machine comprising a casing, an internally toothed annular gear rotatably mounted in the casing, an externally toothed pinion in engagement with the annular gear in a part thereof, with a space between the pinion and the annular gear in another part thereof, a filling member arranged in the space between the annular gear and the pinion and comprising a first radially inwardly disposed filling member portion adjacent the pinion and a second radially outwardly disposed filling member portion adjacent the annular gear, the filling member portions being in mutually facing relationship at a separating surface extending substantially peripherally of the annular gear, each filling member portion having a recess so arranged that the recesses in the respective filling member portions face towards each other, each recess having an inclined surface whereby the inclines surfaces of the recesses define a space of a wedge-like configuration between the respective filling member portions, a sealing roller arranged movably in said space of wedge-like configuration and adapted to co-operate with said inclined surfaces in sealing relationship therewith, a support surface adjacent one of said surfaces, a spring operatively disposed between said roller and said support surface, the spring being adapted to urge said roller into the wedge-like configuration of said inclined surfaces thereby to urge the filling member portions away from each other, the spring being of a hairpin configuration and having limbs bearing in at least substantially parallel relationship against the sealing roller and against said support means respectively, and having a curved end, and a free space in a portion of said casing, the curved end of said spring being accommodated in said free space.

10. An internal-gear machine as set forth in claim 9 wherein said casing portion is a main body portion of said casing.

11. An internal-gear machine as set forth in claim 9 wherein said casing portion comprises an axial plate portion which bears against said filling member.

* * * * *